United States Patent [19]

Dietrich

[11] Patent Number: 4,922,216

[45] Date of Patent: May 1, 1990

[54] ELECTROMAGNETIC SWITCHING DEVICE

[75] Inventor: Bernhard Dietrich, Eichenau, Fed. Rep. of Germany

[73] Assignee: SDS - Relais AG, Deisenhofen, Fed. Rep. of Germany

[21] Appl. No.: 281,786

[22] Filed: Dec. 9, 1988

[30] Foreign Application Priority Data

Dec. 18, 1987 [DE] Fed. Rep. of Germany ..... 3743122

[51] Int. Cl.[5] ..... H01H 67/02

[52] U.S. Cl. ..... 335/128; 335/83

[58] Field of Search ..... 335/129, 78–86, 335/106, 115, 121, 126

[56] References Cited

U.S. PATENT DOCUMENTS 4,618,842 10/1986 Nestlen et al. ..... 335/124

FOREIGN PATENT DOCUMENTS 2719870 8/1978 Fed. Rep. of Germany ..... 335/128

242020 9/1946 Switzerland .

*Primary Examiner*—Leo P. Picard

*Assistant Examiner*—Lincoln Donovan

*Attorney, Agent, or Firm*—Foley & Lardner, Schwartz, Jeffery, Schwaab, Mack, Blumenthal & Evans

[57] ABSTRACT

An electromagnetic switching device comprises a solenoid actuator 18 including an armature 22, the reciprocating movement of which is converted by a pair of levers 25, 26 to a reciprocating counter-movement of a contact slider 16 extending parallel thereto. The contact slider 16 is provided with bridge contacts 17*b* which cooperate with stationary contacts 12 fixed within a base 10. Outwardly projecting guide members 30 which are provided on the solenoid actuator 18 and extend through recesses 31 formed in the levers 25, 26 serve to support the latter. Upon assembly, the solenoid actuator 18 is equipped with the levers 25, 26 and the contact slider 16 to form an assembly unit which is inserted as it is into the base 10. In this assembly unit, the levers 25, 26 are retained in position so that the assembly step can be performed easily and rapidly without any mounting aids.

8 Claims, 1 Drawing Sheet

ELECTROMAGNETIC SWITCHING DEVICE

BACKGROUND OF THE INVENTION

The present invention relates to an electromagnetic switching device of the general type known from West German Patent Specification No. 3,417,891. In this prior art switching device, a contact slider is coupled to the armature of a solenoid actuator, which armature is reciprocable parallel to the slider, via pairs of levers that are pivotally mounted on journals provided on a housing base. Upon assembly, the solenoid actuator is first assembled alone, whereupon the levers are installed in fitting their two arms on the ends of the armature and contact slider. The thus assembled arrangement is then mounted in the housing base, and in this process, bores formed in the levers must simultaneously be fitted onto the journals.

Due to the fact that, prior to the final mounting in the housing member, the assembled arrangement mentioned above is not positioned in rigid relationship, the assembly step is a rather difficult operation. It is made still more difficult by the fact that the spacing between the journals does not exactly correspond to the spacing between the bores formed in the levers, because in addition to unavoidable machining tolerances there must be some bearing clearance between the ends of the armature and contact slider, on the one hand, and the ends of the levers, on the other hand, especially when the journals are inserted as separate elements in the housing base. A particular difficulty will arise when the solenoid actuator comprises a permanent magnet for achieving a polarized switching performance, which magnet will pull the armature at random to either one of its limit positions.

For all these reasons, the assembly of the known switching device is troublesome and time-consuming and in many cases cannot be effected without auxiliary means.

SUMMARY OF THE INVENTION

It is an object of the present invention to obviate the drawbacks existing in the prior art and provide a switching device of the type specified above designed in such a way that it may be assembled more rapidly and easily.

To meet this object, the electromagnetic switching device of the invention comprises a contact arrangement including at least one stationary contact disposed in a housing member and a contact slider inserted in the housing member and carrying a contact movable relative to the stationary contact, a solenoid actuator inserted in the housing member and including a bobbin, at least one coil and an armature movable substantially parallel to the direction of movement of the contact slider and at least one two-armed lever pivotable about a fixed bearing location, one arm of the lever being coupled to an end of the contact slider and the other arm being coupled to an end of the armature, wherein the bearing location for the lever comprises at least one guide member which projects from the outside of the solenoid actuator substantially parallel to the direction of movement of the armature and extends through a recess formed in the lever, and a bearing surface formed on the housing member for supporting an outer surface of the lever in the vicinity of the recess.

In this device, the or each lever is fixed to the solenoid actuator in the direction of its pivot axis, i.e. in the direction in which the assembly unit composed of solenoid actuator, contact slider and lever or levers is inserted in the housing member, so that the components of the assembly unit are already held in defined positions relative to each other and the inserting step does not require any probing into a bearing location, as in the known device. Rather, the entire assembly unit can be inserted simply in such a way that the bearing surface formed by the housing member comes to lie on the outside of the guide member for the respective lever. Such an inserting operation may easily be performed manually without any auxiliary means, irrespective of the actual position of the contact slider.

In a preferred embodiment, the bearing surface, which faces the lever, is configured to form a knife-edge bearing, to provide a bearing with minimum friction even though there is no journal.

In another embodiment, the guide member and sthe recess are of elongate shape in the direction of an axis about which the lever is pivotable. This results in a tilt-free bearing of the lever, which is guided on the respective assembly with respect to all degrees of freedom expect for an outward movement which in turn is prevented by the bearing surface of the housing member.

Advantageously, each lever is formed with two recesses which are open towards opposite sides, and a guide member extends through each of the recesses. This measure results in a support of the levers which is beneficial to the stability of the aforementioned assembly unit and thus also results in the assembly unit being received without any difficulties in the base during the insertion operation.

As another development of the invention, two levers are disposed on opposite sides of the solenoid actuator to constitute a parallelogram linkage together with the contact slider and the armature, the contact slider and armature having stepped ends extending through openings formed in the arms of both levers and being supported by the levers to constitute operative connections of the parallelogram linkage, due to which the prior known advantages of a low-friction bearing of all movable parts is retained. The openings formed in the lever arms act to permit the levers to be simply inserted irrespective of the position of the armature.

Further measures may be combined with the concept of the present invention to achieve a monostable switching performance with a compact overall structure.

BRIEF DESCRIPTION OF THE APPLICATION DRAWINGS

A preferred embodiment of the invention will be explained in detail with reference to the drawing, in which FIG. 1 is a longitudinal sectional view of an electromagnetic switching device taken along the line I—I in FIG. 2, and FIG. 2 is a cross-section taken along the line II—II in FIG. 1.

DETAILED DESCRIPTION OF THE PREFERRED EMBODIMENTS

Figure 1:
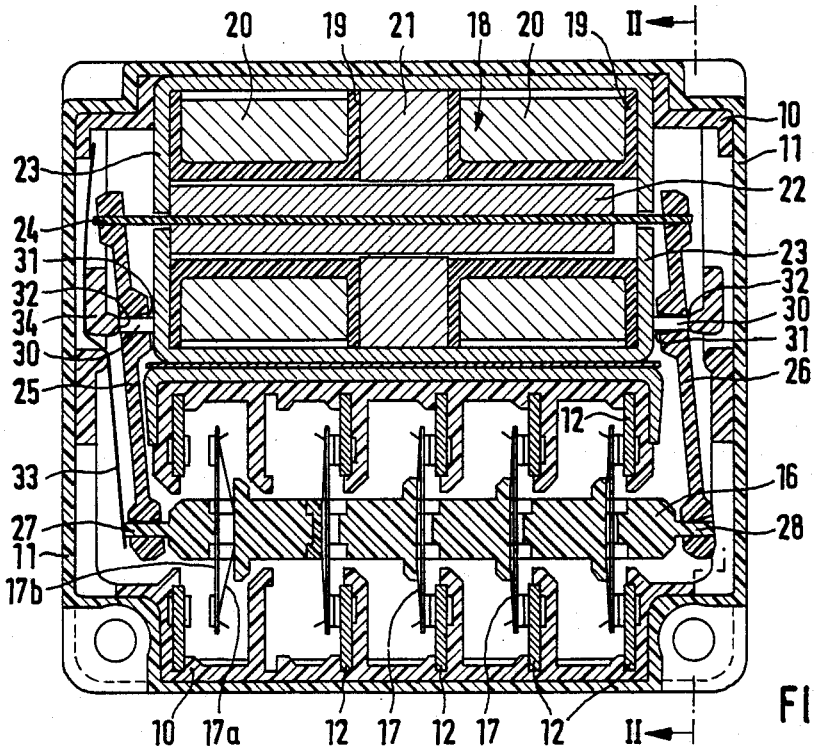

The electromagnetic switching device illustrated in the drawing is accommodated in a housing composed of a base 10 and a housing cap 11. In the lower portion of the base 10, as viewed in FIG. 1, there are provided a plurality of switching chambers each including two stationary contacts 12 disposed in mutually aligned relationship. As will be apparent from FIG. 2, these stationary contacts 12 comprise lower terminals 13 projecting through the base 10 and upper terminals 14 projecting through the housing cap 11. The lower terminals 13 are used for insertion into a printed circuit board (not illustrated) while the upper terminals 14 are provided for further connections and are disposed in a recessed portion 15 at the top of the housing cap 11.

A contact slider 16 is provided with a number of movable bridge contacts 17*b* which are supported through leaf springs 17*a*, each bridge contact 17*b* cooperating with a pair of mutually aligned stationary contacts 12. In the embodiment illustrated in FIG. 1, the stationary contacts 12 are disposed in such a way and the movable contacts 17*b* are biased in such a way that a total of four normally closed double-break contact couples and one normally open contact couple, also of double-break type, are formed.

In the upper portion of the housing, as viewed in FIG. 1, there is accommodated a solenoid actuator 18 which comprises two coils 20 each wound on a bobbin 19, a permanent magnet 21 disposed therebetween, an armature 22 extending through a central hole formed in the bobbins 19 and in the permanent magnet 21 and reciprocable in the axial direction of the coils, and two yokes 23 extending over the outer sides of the bobbins 19. The armature 22 is mounted on a guide bar 24 which extends in coaxial relationship with the coils 20 and the ends of which pass through openings left between the two yokes 23.

Figure 2:
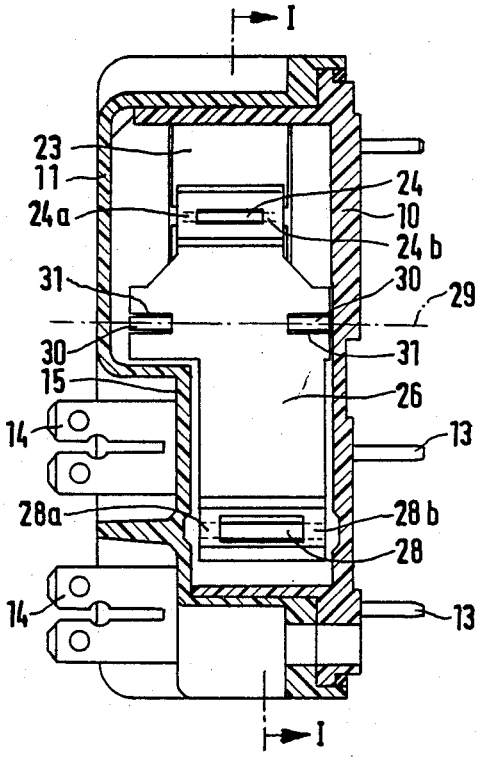

The reciprocating movement of the armature 22 is transmitted to the contact slider 16 via two levers 25, 26. Either arm of each lever 25, 26 is provided at its end with an opening through which a portion of the respective stepped outer end of the guide bar 24 and of the respective end portions 27, 28 of the contact slider 16 is passed. As illustrated in FIG. 2, the remainder of the stepped end of the guide bar 24 and, respectively, the remainder of the end portions 27, 28 of the contact slider 16 are supported in steps 24*a*, 24*b* and 28*a*, 28*b* (shown in phantom lines) at the ends of the levers 25, 26 facing the solenoid actuator 18 and the contact slider 16, respectively.

As will be apparent from FIG. 1, the lower yoke 23 is inserted between a pair of approximately parallelepipedic guide members 30 which project outwardly from the bobbin 19 and extend through recesses 31 formed in the levers 25, 26. The guide members 30 serve to support the levers 25, 26 for pivotal movement about pivot axes which extend normal to the plane of the drawing in FIG. 1 and of which one is indicated at 29 in FIG. 2. As will be apparent from FIG. 2, the two guide members 30 are disposed on opposite sides of the lower yoke 23 at a spacing which is slightly larger than the width of the yoke 23, the guide members 30 being mutually aligned along the pivot axis 29. The recesses 31 formed in the levers 25, 26 are configured as cut-outs which are open towards the lateral edge of the levers such that the levers are fixed in their proper position by the broad sides of the guide members 30 in the upward and downward directions and by the narrow inward sides of the guide members 30 in left-hand and right-hand directions (as viewed in FIG. 2).

Thus, each lever is guided in either direction along the pivot axis 29. Any outward movement of the levers 25, 26 is prevented by bearing surfaces 32 integral with the base 10. Each bearing surface 32 includes a convex portion facing the respective lever 25, 26 so as to minimize the bearing friction in the way of a knife-edge bearing. The spacing between the bearing surfaces 32 is dimensioned so that, upon insertion of the solenoid actuator 18, the outer surfaces of the guide members 30 may pass therebetween. The sectional plane II—II illustrated in FIG. 1 extends in the tangent plane between the right-hand bearing surface 32 and the guide member 30.

The levers 25, 26, the armature 22, and the contact slider 16 together constitute a parallelogram linkage supported at the two pivot axes 29 to convert the reciprocating movement of the armature 22 into a reciprocating countermovement of the contact slider 16 which extends in parallel thereto. All of the openings in the levers 25, 26 are slightly wedge-shaped so as not to obstruct the free movability of the parallelogram linkage.

FIG. 1 furthermore shows a leaf spring 33 the free end of which acts on the end portion 27 of the contact slider 16 projecting through the recess in the lever 25, so that the contact slider is biased towards its right-hand limit position (as viewed in FIG. 1). The other half of the leaf spring 33, while still being within the housing cap 11, is inserted into the base 10 in such a way that it is disposed on the outside of an integrally formed portion 34, which constitutes the outer bearing surface 32 for the lever 25, and extends upwardly from the inner surface of the base 10.

During assembly, the solenoid actuator 18 is first assembled from the components 19 to 24 and is then fitted with the two levers 25, 26 and the contact slider 16 to form an assembly unit. As the levers 25, 26 already in this condition are guided and retained on a part of the solenoid actuator 18, viz. on the guide members 30 provided on the bobbin 19, and therefore also retain the contact slider 16 in a defined manner, it is easily possible to handle this assembly unit and insert it properly into the base 10 so that the outer ends of the guide members 30 are fitted between the bearing surfaces 32 provided on the integrally formed portions 34 of the base 10. In the inserted state, the levers 25, 26 are also retained by the bearing surfaces 32 against any outward movement. Finally, the leaf spring 33, if provided, is inserted so that the switching device is ready for operation after sealing by means of the housing cap 11.

In operation and for switching-over from the inoperative position illustrated in FIG. 1, the right-hand coil 20 is energized so that the armature 22 is pulled to the right-hand limit position as viewed in FIG. 1, whereby the levers 25, 26 turn about their pivot axes 29 and the contact slider 16 is shifted towards the left against the bias of the leaf spring 33. Upon de-energization of the coil 20 the parallelogram linkage is returned by the leaf spring 33 to the inoperative position shown in FIG. 1. When the leaf spring 33 is not provided, this return is effected by energization of the left-hand coil 20 as viewed in FIG. 1. It is also possible, instead of energizing only the respective one coil, to apply current to both coils simultaneously but in opposite directions for the two travelling directions of the armature 22.

I claim:

1. An electromagnetic switching device, comprising:

a contact arrangement including at least one stationary contact disposed in a housing member and a contact slider inserted in said housing member and carrying a contact movable relative to the stationary contact;

a solenoid actuator inserted in said housing member and including a bobbin, at least one coil and an armature movable substantially parallel to the direction of movement of the contact slider;

two levers disposed on opposite sides of said solenoid actuator to constitute a parallelogram linkage together with said contact slider and said armature, said contact slider and armature having stepped ends extending through openings formed in the arms of both levers and being supported by said levers to constitute operative connections of said parallelogram linkage;

bearing locations for said levers comprising guide members which project from the outside of said solenoid actuator substantially parallel to the direction of movement of said armature and extend through recesses formed in said levers, and bearing surfaces formed on said housing member for supporting outer surfaces of said levers in the vicinity of said recesses.

2. The switching device of claim 1, wherein said bearing surfaces, which face said levers, are configured to form a knife-edge bearing.

3. The switching device of claim 1, wherein said guide members and said recesses are of elongate shape in the direction of an axis about which the levers are pivotable.

4. The switching device of claim 1, wherein said levers are formed with two recesses which are open towards opposite sides, a guide member extending through each of said recesses.

5. The switching device of claim 1, including a spring for biasing said contact slider towards a limit position, said spring being fixed in said housing member on the side of one of said levers remote from said solenoid actuator and bearing against an end of said one lever.

6. The switching device of claim 1, including a spring for biasing said contact slider towards a limit position, said spring being fixed in said housing member on the side of one of said levers remote from said solenoid actuator and bearing against an end of one of said contact slider and said armature, said end extending through an opening in said one lever.

7. The switching device of claim 5, wherein said spring is a leaf spring inserted in said housing member in such a way that its fixed end is disposed on the outer side of an integrally formed portion which constitutes said bearing surface for one of said levers.

8. An electromagnetic switching device, comprising:

a contact arrangement including at least one stationary contact disposed in a housing member and a contact slider inserted in said housing member and carrying a contact movable relative to the stationary contact;

a solenoid actuator inserted in said housing member and including a bobbin, at least one coil and an armature movable substantially parallel to the direction of movement of the contact slider;

two levers disposed on opposite sides of said solenoid actuator to constitute a parallelogram linkage together with said contact slider and said armature, said contact slider and armature engaging the arms of both levers and being supported by said levers to constitute operative connections of said parallelogram linkage;

bearing locations for said levers comprising at guide members which project from the outside of said solenoid actuator substantially parallel to the direction of movement of said armature and extend through recesses formed in said levers, and bearing surfaces formed on said housing member for supporting outer surfaces of said levers in the vicinity of said recesses.

* * * * *